US007736599B2

(12) United States Patent
Chiu et al.

(10) Patent No.: US 7,736,599 B2
(45) **Date of Patent: *Jun. 15, 2010**

(54) REACTOR DESIGN TO REDUCE PARTICLE DEPOSITION DURING PROCESS ABATEMENT

(75) Inventors: Ho-Man Rodney Chiu, San Jose, CA (US); Daniel O. Clark, Pleasanton, CA (US); Shaun W. Crawford, San Ramon, CA (US); Jay J. Jung, Sunnyvale, CA (US); Leonard B. Todd, Napa, CA (US); Robbert Vermeulen, Pleasant Hill, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1072 days.

This patent is subject to a terminal disclaimer.

(21) Appl. No.: 10/987,921

(22) Filed: Nov. 12, 2004

(65) Prior Publication Data

US 2006/0104879 A1 May 18, 2006

(51) Int. Cl.
*B01D 50/00* (2006.01)
*F01N 3/10* (2006.01)

(52) U.S. Cl. ..... 422/168; 422/171; 422/172; 422/173

(58) Field of Classification Search ..... 422/168, 422/169, 171, 172, 173; 55/240, 248
See application file for complete search history.

(56) References Cited

U.S. PATENT DOCUMENTS

| | | | |
|---|---|---|---|
| 2,819,151 | A | 1/1958 | Flemmert |
| 3,185,846 | A | 5/1965 | Gilbert et al. |
| 3,203,759 | A | 8/1965 | Flemmert |
| 3,276,506 | A | 10/1966 | Micko |
| 3,603,711 | A | 9/1971 | Downs |
| 3,698,696 | A | 10/1972 | Rauskolb |
| 3,813,852 | A | 6/1974 | Steineke |

(Continued)

FOREIGN PATENT DOCUMENTS

DD 0215706 A1 11/1984

(Continued)

OTHER PUBLICATIONS

Abreu, et al. Causes of anomalous solid formation in the exhaust system of low-pressure chemical vapor deposition plasma enhanced chemical vapor deposition semiconductor processes, J. Vac. Sci. Technol B 12(4) Jul./Aug. 1994, pp. 2763/2767.

(Continued)

*Primary Examiner*—Tom Duong
(74) *Attorney, Agent, or Firm*—Dugan & Dugan, PC

(57) ABSTRACT

The present invention relates to systems and methods for controlled combustion and decomposition of gaseous pollutants while reducing deposition of unwanted reaction products from within the treatment systems. The systems include a novel thermal reaction chamber design having stacked reticulated ceramic rings through which fluid, e.g., gases, may be directed to form a boundary layer along the interior wall of the thermal reaction chamber, thereby reducing particulate matter buildup thereon. The systems further include the introduction of fluids from the center pilot jet to alter the aerodynamics of the interior of the thermal reaction chamber.

25 Claims, 10 Drawing Sheets

U.S. PATENT DOCUMENTS

| | | | |
|---|---|---|---|
| 3,845,191 | A | 10/1974 | Bruce et al. |
| 3,898,040 | A | 8/1975 | Tabak |
| 3,949,057 | A | 4/1976 | Gilbert, Jr. |
| 3,969,482 | A | 7/1976 | Teller |
| 3,969,485 | A | 7/1976 | Flemmert |
| 3,983,021 | A | 9/1976 | Henis |
| 4,011,298 | A | 3/1977 | Fukui et al. |
| 4,059,386 | A | 11/1977 | Eising |
| 4,083,607 | A | 4/1978 | Mott |
| 4,154,141 | A | 5/1979 | Sayles |
| 4,172,708 | A | 10/1979 | Wu et al. |
| 4,206,189 | A | 6/1980 | Kosintsev et al. |
| 4,236,464 | A | 12/1980 | Anderson et al. |
| 4,238,460 | A | 12/1980 | Aiken et al. |
| 4,243,372 | A | 1/1981 | Cade |
| 4,296,079 | A | 10/1981 | Hauser |
| 4,374,649 | A | 2/1983 | Rao |
| 4,392,821 | A | 7/1983 | Füssl et al. |
| 4,479,443 | A | 10/1984 | Faldt et al. |
| 4,479,809 | A | 10/1984 | Johnson et al. |
| 4,483,672 | A | 11/1984 | Wallace et al. |
| 4,519,999 | A | 5/1985 | Coleman |
| 4,541,995 | A | 9/1985 | Kim et al. |
| 4,555,389 | A | 11/1985 | Soneta et al. |
| 4,584,001 | A | 4/1986 | Dechene |
| 4,644,877 | A | 2/1987 | Barton et al. |
| 4,661,056 | A | 4/1987 | Vickery et al. |
| 4,719,088 | A | 1/1988 | Itoh et al. |
| 4,753,915 | A | 6/1988 | Vogt et al. |
| 4,788,036 | A | 11/1988 | Eiselstein et al. |
| 4,801,437 | A | 1/1989 | Konagaya et al. |
| 4,834,020 | A | 5/1989 | Bartholomew |
| 4,886,444 | A | 12/1989 | Hirase et al. |
| 4,908,191 | A | 3/1990 | Boldish et al. |
| 4,935,212 | A | 6/1990 | Jacob |
| 4,954,320 | A | 9/1990 | Birmingham et al. |
| 4,966,611 | A | 10/1990 | Schumacher et al. |
| 4,975,098 | A | 12/1990 | Lee et al. |
| 4,981,722 | A | 1/1991 | Moller et al. |
| 4,986,838 | A | 1/1991 | Johnsgard |
| 4,993,358 | A | 2/1991 | Mahawili |
| 5,000,221 | A | 3/1991 | Palmer |
| 5,009,869 | A | 4/1991 | Weinberg et al. |
| 5,011,520 | A | 4/1991 | Carr et al. |
| 5,045,288 | A | 9/1991 | Raupp et al. |
| 5,045,511 | A | 9/1991 | Bosomworth et al. |
| 5,077,525 | A | 12/1991 | West et al. |
| 5,113,789 | A | 5/1992 | Kamian |
| 5,114,683 | A | 5/1992 | Hirase |
| 5,118,286 | A | 6/1992 | Sarin |
| 5,122,391 | A | 6/1992 | Mayer |
| 5,123,836 | A | 6/1992 | Yoneda et al. |
| 5,136,975 | A | 8/1992 | Bartholomew et al. |
| 5,137,701 | A | 8/1992 | Mundt |
| 5,147,421 | A | 9/1992 | Yung |
| 5,151,116 | A | 9/1992 | Scholz et al. |
| 5,154,237 | A | 10/1992 | Cooper |
| 5,160,707 | A | 11/1992 | Murray et al. |
| 5,176,897 | A | 1/1993 | Lester |
| 5,183,646 | A | 2/1993 | Anderson et al. |
| 5,199,856 | A | 4/1993 | Epstein et al. |
| 5,206,003 | A | 4/1993 | Imoto et al. |
| 5,207,836 | A | 5/1993 | Chang |
| 5,211,729 | A | 5/1993 | Sherman |
| 5,213,767 | A | 5/1993 | Smith et al. |
| 5,220,940 | A | 6/1993 | Palmer |
| 5,238,656 | A | 8/1993 | Tajima et al. |
| 5,251,654 | A | 10/1993 | Palmer |
| 5,252,007 | A | 10/1993 | Klinzing et al. |
| 5,255,709 | A | 10/1993 | Palmer |
| 5,255,710 | A | 10/1993 | Palmer |
| 5,271,908 | A | 12/1993 | Shiban et al. |
| 5,280,664 | A | 1/1994 | Lin |
| 5,281,302 | A | 1/1994 | Gabric et al. |
| 5,292,704 | A | 3/1994 | Lester |
| 5,304,398 | A | 4/1994 | Krussell et al. |
| 5,320,124 | A | 6/1994 | Palmer |
| 5,361,800 | A | 11/1994 | Ewing |
| 5,364,604 | A | 11/1994 | Spink et al. |
| 5,393,394 | A | 2/1995 | Ikeda et al. |
| 5,407,647 | A | 4/1995 | Tarancon |
| 5,417,934 | A | 5/1995 | Smith et al. |
| 5,425,886 | A | 6/1995 | Smith |
| 5,439,568 | A | 8/1995 | Uchiyama |
| 5,450,873 | A | 9/1995 | Palmer et al. |
| 5,453,125 | A | 9/1995 | Krogh |
| 5,453,494 | A | 9/1995 | Kirlin et al. |
| 5,456,280 | A | 10/1995 | Palmer |
| 5,494,004 | A | 2/1996 | Hunter, Jr. |
| 5,495,893 | A | 3/1996 | Roberts et al. |
| 5,510,066 | A | 4/1996 | Fink et al. |
| 5,510,093 | A | 4/1996 | Bartz et al. |
| 5,527,631 | A | 6/1996 | Singh et al. |
| 5,533,890 | A | 7/1996 | Holst et al. |
| 5,572,866 | A | 11/1996 | Loving |
| 5,575,636 | A | 11/1996 | Kobayashi et al. |
| 5,584,959 | A | 12/1996 | Kimura et al. |
| 5,589,148 | A | 12/1996 | Otsuka et al. |
| 5,597,540 | A | 1/1997 | Akita et al. |
| 5,599,508 | A | 2/1997 | Martinelli et al. |
| 5,601,790 | A | 2/1997 | Stilger et al. |
| 5,603,905 | A | 2/1997 | Bartz et al. |
| 5,643,545 | A | 7/1997 | Chen et al. |
| 5,649,985 | A | 7/1997 | Imamura |
| 5,650,128 | A | 7/1997 | Holst et al. |
| 5,663,476 | A | 9/1997 | Cripe et al. |
| 5,665,317 | A | 9/1997 | Laslo |
| 5,693,293 | A | 12/1997 | Reichardt et al. |
| 5,702,999 | A | 12/1997 | Mazanec et al. |
| H1701 | H | 1/1998 | DePinto et al. |
| 5,716,428 | A | 2/1998 | Imamura |
| 5,720,444 | A | 2/1998 | Wheeler et al. |
| 5,720,931 | A | 2/1998 | Rossin et al. |
| 5,749,720 | A | 5/1998 | Fukuda et al. |
| 5,756,052 | A | 5/1998 | Suzumura |
| 5,759,237 | A | 6/1998 | Li et al. |
| 5,759,498 | A | 6/1998 | Sheu et al. |
| 5,762,893 | A | 6/1998 | Scholz et al. |
| 5,779,863 | A | 7/1998 | Ha et al. |
| 5,779,998 | A | 7/1998 | Tom |
| 5,785,741 | A | 7/1998 | Li et al. |
| 5,788,778 | A | 8/1998 | Shang et al. |
| 5,790,934 | A | 8/1998 | Say et al. |
| 5,800,792 | A | 9/1998 | Ibaraki et al. |
| 5,817,284 | A | 10/1998 | Nakano et al. |
| 5,833,888 | A | 11/1998 | Arya et al. |
| 5,840,897 | A | 11/1998 | Kirlin et al. |
| 5,843,239 | A | 12/1998 | Shrotriya |
| 5,843,288 | A | 12/1998 | Yamamoto |
| 5,855,648 | A | 1/1999 | Prasad et al. |
| 5,855,822 | A | 1/1999 | Chen |
| 5,858,065 | A | 1/1999 | Li et al. |
| 5,865,879 | A | 2/1999 | Lee |
| 5,877,391 | A | 3/1999 | Kanno et al. |
| 5,891,404 | A | 4/1999 | Ibaraki et al. |
| 5,900,217 | A | 5/1999 | Hartung et al. |
| 5,914,091 | A | 6/1999 | Holst et al. |
| 5,919,285 | A | 7/1999 | Li et al. |
| 5,935,283 | A | 8/1999 | Sweeney et al. |
| 5,935,540 | A | 8/1999 | Otsuka et al. |
| 5,938,422 | A | 8/1999 | Smith et al. |
| 5,955,037 | A | 9/1999 | Holst et al. |
| 5,957,678 | A | 9/1999 | Endoh et al. |
| 5,965,786 | A | 10/1999 | Rostaing et al. |

| | | | |
|---|---|---|---|
| 5,972,078 | A | 10/1999 | Collins et al. |
| 5,989,412 | A | 11/1999 | Okagami et al. |
| 5,992,409 | A | 11/1999 | Heimlich et al. |
| 6,007,742 | A | 12/1999 | Czernichowski et al. |
| 6,009,827 | A | 1/2000 | Robles et al. |
| 6,010,576 | A | 1/2000 | Lin |
| 6,013,584 | A | 1/2000 | M'saad et al. |
| 6,030,591 | A | 2/2000 | Tom et al. |
| 6,059,858 | A | 5/2000 | Lin et al. |
| 6,072,227 | A | 6/2000 | Yau et al. |
| 6,095,084 | A | 8/2000 | Shamouilian et al. |
| 6,110,529 | A | 8/2000 | Gardiner et al. |
| 6,153,150 | A | 11/2000 | Moore et al. |
| 6,153,159 | A | 11/2000 | Engeler et al. |
| 6,185,839 | B1 | 2/2001 | Kholodenko et al. |
| 6,187,072 | B1 | 2/2001 | Cheung et al. |
| 6,187,080 | B1 | 2/2001 | Ping-Chung et al. |
| 6,190,507 | B1 | 2/2001 | Whealton et al. |
| 6,217,640 | B1 | 4/2001 | Lu et al. |
| 6,234,787 | B1 | 5/2001 | Endoh et al. |
| 6,261,524 | B1 | 7/2001 | Herman et al. |
| 6,322,756 | B1 | 11/2001 | Arno et al. |
| 6,338,312 | B2 | 1/2002 | Hayes et al. |
| 6,345,768 | B1 | 2/2002 | Inagaki et al. |
| 6,361,584 | B1 | 3/2002 | Stevens et al. |
| 6,423,284 | B1 | 7/2002 | Arno et al. |
| 6,464,944 | B1 | 10/2002 | Moore et al. |
| 6,468,490 | B1 | 10/2002 | Shamouilian et al. |
| 6,491,884 | B1 | 12/2002 | Faller et al. |
| 6,494,711 | B1 | 12/2002 | Takemura et al. |
| 6,511,641 | B2 | 1/2003 | Herman et al. |
| 6,527,828 | B2 | 3/2003 | Flippo et al. |
| 6,544,482 | B1 | 4/2003 | Inori |
| 6,551,381 | B2 | 4/2003 | Flippo et al. |
| 6,655,137 | B1 | 12/2003 | Sardari |
| 6,712,603 | B2 | 3/2004 | Pettit |
| 6,736,635 | B1 | 5/2004 | Takemura et al. |
| 6,805,728 | B2 | 10/2004 | Sweeney et al. |
| 6,813,943 | B2 | 11/2004 | Smith et al. |
| 6,824,748 | B2 | 11/2004 | Kaushal et al. |
| 6,843,830 | B2 | 1/2005 | Sherer |
| 6,875,007 | B2 | 4/2005 | Pettit |
| 6,946,107 | B2 | 9/2005 | Carlborg et al. |
| 6,969,250 | B1 | 11/2005 | Kawamura et al. |
| 7,047,893 | B2 | 5/2006 | Loving |
| 7,160,521 | B2 | 1/2007 | Porshnev et al. |
| 7,316,721 | B1 | 1/2008 | Redden et al. |
| 2001/0001652 | A1 | 5/2001 | Kanno et al. |
| 2001/0032543 | A1 | 10/2001 | Seeley et al. |
| 2001/0055555 | A1 | 12/2001 | Herman et al. |
| 2002/0066535 | A1 | 6/2002 | Brown et al. |
| 2002/0110500 | A1 | 8/2002 | Moore et al. |
| 2002/0159924 | A1 | 10/2002 | Arno et al. |
| 2002/0182131 | A1 | 12/2002 | Kaushal et al. |
| 2004/0028590 | A1 | 2/2004 | Tsuji et al. |
| 2004/0065013 | A1 | 4/2004 | DeVries |
| 2004/0161718 | A1 | 8/2004 | Pettit |
| 2004/0191146 | A1 | 9/2004 | Shinohara et al. |
| 2004/0213721 | A1 | 10/2004 | Arno et al. |
| 2004/0216610 | A1 | 11/2004 | Tom et al. |
| 2004/0237781 | A1 | 12/2004 | Terada et al. |
| 2005/0135984 | A1 | 6/2005 | Ferron |
| 2006/0024226 | A1 | 2/2006 | Park et al. |
| 2006/0104879 | A1 | 5/2006 | Chiu et al. |
| 2007/0169889 | A1 | 7/2007 | Clark |
| 2007/0172398 | A1 | 7/2007 | Clark |
| 2007/0172399 | A1 | 7/2007 | Clark |
| 2007/0190469 | A1 | 8/2007 | Clark |
| 2007/0274876 | A1 | 11/2007 | Chiu et al. |
| 2009/0010816 | A1 | 1/2009 | Ferron et al. |

FOREIGN PATENT DOCUMENTS

| | | | |
|---|---|---|---|
| DE | 4311061 | A1 | 10/1994 |
| DE | 4319118 | A1 | 12/1994 |
| DE | 4321762 | A1 | 1/1995 |
| DE | 19526737 | | 1/1997 |
| EP | 0306540 | A1 | 3/1989 |
| EP | 0 360 941 | A2 | 4/1990 |
| EP | 0 412 456 | A2 | 2/1991 |
| EP | 0 597 393 | A1 | 5/1994 |
| EP | 0642809 | A1 | 3/1995 |
| EP | 0 694 735 | A1 | 1/1996 |
| EP | 0 802 370 | A2 | 10/1997 |
| EP | 0 809 071 | A1 | 11/1997 |
| EP | 0 861 683 | A2 | 9/1998 |
| EP | 0 885 648 | A1 | 12/1998 |
| EP | 0916388 | A2 | 5/1999 |
| EP | 916388 | A2 * | 5/1999 |
| EP | 0 919 773 | A1 | 6/1999 |
| EP | 0 933 120 | A1 | 8/1999 |
| EP | 1 129 775 | A1 | 9/2001 |
| EP | 1 143 197 | A1 | 10/2001 |
| EP | 1 240 937 | A1 | 9/2002 |
| EP | 1 431 657 | A1 | 6/2004 |
| FR | 2 062 565 | | 6/1971 |
| GB | 2 028 998 | A | 3/1980 |
| JP | 51-129868 | | 11/1976 |
| JP | 57-091725 | | 6/1982 |
| JP | 57-117333 | | 7/1982 |
| JP | 58-045718 | | 3/1983 |
| JP | 59-082927 | | 5/1984 |
| JP | 61-021717 | | 1/1986 |
| JP | 61-200851 | | 9/1986 |
| JP | 62-273039 | | 11/1987 |
| JP | 63-062528 | | 3/1988 |
| JP | 02-068414 | | 3/1990 |
| JP | 02-102719 | | 4/1990 |
| JP | 02 225905 | A | 9/1990 |
| JP | 3-9768 | | 2/1991 |
| JP | 03-047516 | | 2/1991 |
| JP | 91009768 | | 2/1991 |
| JP | 03-065218 | | 3/1991 |
| JP | 03-262523 | | 11/1991 |
| JP | 04-050422 | | 2/1992 |
| JP | 04-209524 | | 10/1992 |
| JP | 05-192534 | | 8/1993 |
| JP | 05-296979 | | 11/1993 |
| JP | 06-063357 | | 3/1994 |
| JP | 06-137537 | | 5/1994 |
| JP | 06 313532 | A | 11/1994 |
| JP | 07-010335 | | 1/1995 |
| JP | 07-323211 | | 12/1995 |
| JP | 08-309146 | | 11/1996 |
| JP | 08-333453 | | 12/1996 |
| JP | 09 133333 | A | 5/1997 |
| JP | 10-192653 | | 7/1998 |
| JP | 11-070322 | | 3/1999 |
| JP | 11-276860 | | 10/1999 |
| JP | 11-319485 | | 11/1999 |
| JP | 11-335164 | | 12/1999 |
| JP | 2000-108245 | | 4/2000 |
| JP | 2001-082723 | | 3/2001 |
| JP | 2001082723 | A | 3/2001 |
| KR | 1999-007143 | | 1/1999 |
| WO | WO 96/16720 | A1 | 6/1996 |
| WO | WO9749479 | A1 | 12/1997 |
| WO | WO 98/29181 | A1 | 7/1998 |
| WO | WO 99/02921 | A1 | 1/1999 |
| WO | WO 99/61132 | A1 | 2/1999 |
| WO | WO 00/09258 | A1 | 2/2000 |
| WO | WO 00/67879 | A1 | 11/2000 |

| | | | |
|---|---|---|---|
| WO | WO 01/78873 | A1 | 10/2001 |
| WO | WO 2004/031073 | A2 | 4/2004 |
| WO | WO 2005/062772 | | 7/2005 |
| WO | WO 2006/053231 | | 11/2006 |
| WO | WO 2007/053626 | | 12/2007 |

OTHER PUBLICATIONS

Cady, George Hamilton, "Reaction of Fluorine with Water and with Hydroxides", Feb., 1935, J. J. Am. Chem. Soc., vol. 57, pp. 246-249.
Catalytic Decomposition System, Hitachi America, Ltd. Semiconductor Equipment Group-SCDS Gas Abatement Systems, <http://www.hitachi.com/semiequipment/productsscds.html>, pp. 1-2, printed on Apr. 21, 1999.
Environmental—Complete system solutions for air pollution control (Brochure—<http://www.olpidurr.com/e/images/environmental2001.pdf>), Dürr Environmental, Inc. <http://www.olpidurr.com/e/eco/ecopage.htm>, pp. 1-12.
Fenwal Test Detonation Arresting System at NMERI Site, May, 1992 test of Fenwal Detonation Arresting System at New Mexico Engineering Research Institute.
Hardwick, Steven J., et al., "Waste Minimization in Semiconductor Processing", 1994, Mater. Res. Soc. Symp. Proc., vol. 344, pp. 273-278.
Hayakawa, Saburo, "Silane Gas Scrubber", Koatsu Gasu, 24(7), p. 371-9, (1987).
Holmes, John T., et al., "Fluidized Bed Disposal of Fluorine", Oct. 1967, I&EC Process Design and Development, vol. 6, No. 4, pp. 408-413.
Kanken Techno detoxifier KT 1000 Venus, Crystec Technology Trading GmbH, <http://www.crystec.com/ktcvenue.htm>, pp. 1-4, printed on Jul. 27, 1999.
Landau, Ralph, et al., "Industrial handling of FLOURINE", Mar. 1947, Industrial and Engineering Chemistry, vol. 39, No. 3, pp. 281-286.
Langan, John., et al., "Strategies for greenhouse gas reduction", Jul. 1996, Solid State Technology, pp. 115-119.
M. Brinkmann et al., "Unsteady State Treatment of Very Lean Waste Gases in a Network of Catalytic Burners", 1999, Elsevier Science B. V.—Catalysis Today 47, pp. 263-277.
Slabey, Vernon A., et al., "Rate of Reaction of Gaseous Fluorine with Water Vapor at 35° C", (1958), National Advisory Committee for Aeronautics, Technical Note 4374, pp. 1-16.
Smiley, et al. "Continuous Disposal of Fluorine", Industrial and Engineering Chemistry, 1954, vol. 46, No. 2, pp. 244-247.
Streng, A. G., "The Fluorine-Steam Flame and Its Characteristics", Jun. 1962, Combustion Flame, vol. 6, pp. 89-91.
Turnbull, S. G., et al., "Analysis and Disposal of Fluorine", Industrial and Engineering Chemistry, Mar. 1947, vol. 39, No. 3, pp. 286-288.
International Search Report and Written Opinion of International Application No. PCT/US05/040960 (9985-PCT) mailed Aug. 14, 2006.
International Preliminary Report on Patentability of International Application No. PCT/US2005/040960 (9985-PCT) mailed May 24, 2007.
"Integrated Thermal/Wet: CVD Effluent Treatment System", 2002, pp. 1-2, ATMI, Inc., San Jose, CA.
Viswanath et al., "Preparation and study of YSTZ-AL2O3 nanocomposites", Journal of Materials Science, 1999, pp. 2879-2886, vol. 34, Kluwer Academic Publishers.
Fue et al., "Measurement and correlation of volumetric heat transfer coefficieients of cellular ceramics", Experimental Thermal and Fluid Science, 1998, pp. 285-293, vol. 17, Elsevier Science Inc.
Vedula et al, "Test Methodology for the thermal shock characterization of ceramics", Journal of Materials Science, 1998, pp. 5427-5432, vol. 33, Kluwer Academic Publishers.
Office Action of Taiwan Patent Application No. 094139700 (9985/TAI) mailed Jun. 8, 2009.
Office Action of U.S. Appl. No. 11/555,087 mailed Mar. 25, 2008.
Sep. 22, 2008 Response to Office Action of U.S. Appl. No. 11/555,087 mailed Mar. 25, 2008.
Office Action of U.S. Appl. No. 11/555,087 mailed Dec. 24, 2008.
May 26, 2009 Response to Office Action of U.S. Appl. No. 11/555,087 mailed Dec. 24, 2008.
Final Office Action of U.S. Appl. No. 11/555,087 mailed Aug. 11, 2009.
Preliminary Amendment of U.S. Appl. No. 11/838,435 mailed Oct. 5, 2008.
Preliminary Amendment of U.S. Appl. No. 11/838,435 mailed Jul. 9, 2008.
Nov. 10, 2009 Response to Final Office Action of U.S. Appl. No. 11/555,087 mailed Aug. 11, 2009.
Office Action of U.S. Appl. No. 11/555,087 mailed Nov. 20, 2009.

* cited by examiner

REACTOR DESIGN TO REDUCE PARTICLE DEPOSITION DURING PROCESS ABATEMENT

BACKGROUND OF THE INVENTION

1. Field of the Invention

The present invention relates to improved systems and methods for the abatement of industrial effluent fluids, such as effluent gases produced in semiconductor manufacturing processes, while reducing the deposition of reaction products in the treatment systems.

2. Description of the Related Art

The gaseous effluents from the manufacturing of semiconductor materials, devices, products and memory articles involve a wide variety of chemical compounds used and produced in the process facility. These compounds include inorganic and organic compounds, breakdown products of photoresist and other reagents, and a wide variety of other gases that must be removed from the waste gas before being vented from the process facility into the atmosphere.

Semiconductor manufacturing processes utilize a variety of chemicals, many of which have extremely low human tolerance levels. Such materials include gaseous hydrides of antimony, arsenic, boron, germanium, nitrogen, phosphorous, silicon, selenium, silane, silane mixtures with phosphine, argon, hydrogen, organosilanes, halosilanes, halogens, organometallics and other organic compounds.

Halogens, e.g., fluorine ($F_2$) and other fluorinated compounds, are particularly problematic among the various components requiring abatement. The electronics industry uses perfluorinated compounds (PFCs) in wafer processing tools to remove residue from deposition steps and to etch thin films. PFCs are recognized to be strong contributors to global warming and the electronics industry is working to reduce the emissions of these gases. The most commonly used PFCs include, but are not limited to, $CF_4$, $C_2F_6$, $SF_6$, $C_3F_8$, $C_4H_8$, $C_4H_8O$ and $NF_3$. In practice, these PFCs are dissociated in a plasma to generate highly reactive fluoride ions and fluorine radicals, which do the actual cleaning and/or etching. The effluent from these processing operations include mostly fluorine, silicon tetrafluoride ($SiF_4$), hydrogen fluoride (HF), carbonyl fluoride ($COF_2$), $CF_4$ and $C_2F_6$.

A significant problem of the semiconductor industry has been the removal of these materials from the effluent gas streams. While virtually all U.S. semiconductor manufacturing facilities utilize scrubbers or similar means for treatment of their effluent gases, the technology employed in these facilities is not capable of removing all toxic or otherwise unacceptable impurities.

One solution to this problem is to incinerate the process gas to oxidize the toxic materials, converting them to less toxic forms. Such systems are almost always over-designed in terms of treatment capacity, and typically do not have the ability to safely deal with a large number of mixed chemistry streams without posing complex reactive chemical risks. Further, conventional incinerators typically achieve less than complete combustion thereby allowing the release of pollutants, such as carbon monoxide (CO) and hydrocarbons (HC), to the atmosphere. Furthermore, one of the problems of great concern in effluent treatment is the formation of acid mist, acid vapors, acid gases and NOx (NO, $NO_2$) prior to discharge. A further limitation of conventional incinerators is their inability to mix sufficient combustible fuel with a non-flammable process stream in order to render the resultant mixture flammable and completely combustible.

Oxygen or oxygen-enriched air may be added directly into the combustion chamber for mixing with the waste gas to increase combustion temperatures, however, oxides, particularly silicon oxides may be formed and these oxides tend to deposit on the walls of the combustion chamber. The mass of silicon oxides formed can be relatively large and the gradual deposition within the combustion chamber can induce poor combustion or cause clogging of the combustion chamber, thereby necessitating increased maintenance of the equipment. Depending on the circumstances, the cleaning operation of the abatement apparatus may need to be performed once or twice a week.

It is well known in the arts that the destruction of a halogen gas requires high temperature conditions. To handle the high temperatures, some prior art combustion chambers have included a circumferentially continuous combustion chamber made of ceramic materials to oxidize the effluent within the chamber (see, e.g., U.S. Pat. No. 6,494,711 in the name of Takemura et al., issued Dec. 17, 2002). However, under the extreme temperatures needed to abate halogen gases, these circumferentially continuous ceramic combustion chambers crack due to thermal shock and thus, the thermal insulating function of the combustion chamber fails. An alternative includes the controlled decomposition/oxidation (CDO) systems of the prior art, wherein the effluent gases undergo combustion in the metal inlet tubes, however, the metal inlet tubes of the CDO's are physically and corrosively compromised at the high temperatures, e.g., ≈1260° C.-1600° C., needed to efficiently decompose halogen compounds such as $CF_4$.

Accordingly, it would be advantageous to provide an improved thermal reactor for the decomposition of highly thermally resistant contaminants in a waste gas that provides high temperatures, through the introduction of highly flammable gases, to ensure substantially complete decomposition of said waste stream while simultaneously reducing deposition of unwanted reaction products within the thermal reaction unit. Further, it would be advantageous to provide an improved thermal reaction chamber that does not succumb to the extreme temperatures and corrosive conditions needed to effectively abate the waste gas.

SUMMARY OF INVENTION

The present invention relates to methods and systems for providing controlled decomposition of gaseous liquid crystal display (LCD) and semiconductor wastes in a thermal reactor while reducing accumulation of the particulate products of said decomposition within the system. The present invention further relates to an improved thermal reactor design to reduce reactor chamber cracking during the decomposition of the gaseous waste gases.

In one aspect, the present invention relates to a thermal reactor for removing pollutant from waste gas, the thermal reactor comprising:

a) a thermal reaction unit comprising:

i) an exterior wall having a generally tubular form and a plurality of perforations for passage of a fluid therethrough, wherein the exterior wall includes at least two sections along its length, and wherein adjacent sections are interconnected by a coupling;

ii) a reticulated ceramic interior wall defining a thermal reaction chamber, wherein the interior wall has a generally tubular form and concentric with the exterior wall, wherein the interior wall comprises at least two ring sections in a stacked arrangement;

iii) at least one waste gas inlet in fluid communication with the thermal reaction chamber for introducing a waste gas therein; and iv) at least one fuel inlet in fluid communication with the thermal reaction chamber for introducing a fuel that upon combustion produces temperature that decomposes said waste gas in the thermal reaction chamber; and v) means for directing a fluid through the perforations of the exterior wall and the reticulated ceramic interior wall to reduce the deposition and accumulation of particulate matter thereon; and b) a water quench.

In yet another aspect, the present invention relates to a thermal reactor for removing pollutant from waste gas, the thermal reactor comprising:

a) a thermal reaction unit comprising:

i) an exterior wall having a generally tubular form;

ii) an interior wall having a generally tubular form and concentric with the exterior wall, wherein the interior wall defines a thermal reaction chamber;

iii) a reticulated ceramic plate positioned at or within the interior wall of the thermal reaction unit, wherein the reticulated ceramic plate seals one end of the thermal reaction chamber;

iii) at least one waste gas inlet in fluid communication with the thermal reaction chamber for introducing a waste gas therein; and iv) at least one fuel inlet in fluid communication with the thermal reaction chamber for introducing a fuel that upon combustion produces temperature that decomposes said waste gas within the thermal reaction unit; and b) a water quench.

In a further aspect, the present invention relates to a method for controlled decomposition of gaseous pollutant in a waste gas in a thermal reactor, the method comprising:

i) introducing the waste gas to a thermal reaction chamber through at least one waste gas inlet, wherein the thermal reaction chamber is defined by reticulated ceramic walls;

ii) introducing at least one combustible fuel to the thermal reaction chamber;

iii) igniting the combustible fuel in the thermal reaction chamber to effect formation of reaction products and heat evolution, wherein the heat evolved decomposes the waste gas;

iv) injecting additional fluid through the reticulated ceramic walls into the thermal reaction chamber contemporaneously with the combusting of the combustible fuel, wherein the additional fluid is injected in a continuous mode at a force exceeding that of the reaction products approaching the reticulated ceramic walls of the thermal reaction chamber thereby inhibiting deposition of the reaction products thereon; and v) flowing the stream of reaction products into a water quench to capture the reaction products therein.

Other aspects and advantages of the invention will be more fully apparent from the ensuing disclosure and appended claims

DETAILED DESCRIPTION OF PREFERRED EMBODIMENT OF THE INVENTION

The present invention relates to methods and systems for providing controlled decomposition of effluent gases in a thermal reactor while reducing accumulation of deposition products within the system. The present invention further relates to an improved thermal reactor design to reduce thermal reaction unit cracking during the high temperature decomposition of effluent gases.

Waste gas to be abated may include species generated by a semiconductor process and/or species that were delivered to and egressed from the semiconductor process without chemical alteration. As used herein, the term "semiconductor process" is intended to be broadly construed to include any and all processing and unit operations in the manufacture of semiconductor products and/or LCD products, as well as all operations involving treatment or processing of materials used in or produced by a semiconductor and/or LCD manufacturing facility, as well as all operations carried out in connection with the semiconductor and/or LCD manufacturing facility not involving active manufacturing (examples include conditioning of process equipment, purging of chemical delivery lines in preparation of operation, etch cleaning of process tool chambers, abatement of toxic or hazardous gases from effluents produced by the semiconductor and/or LCD manufacturing facility, etc.).

Figure 1:
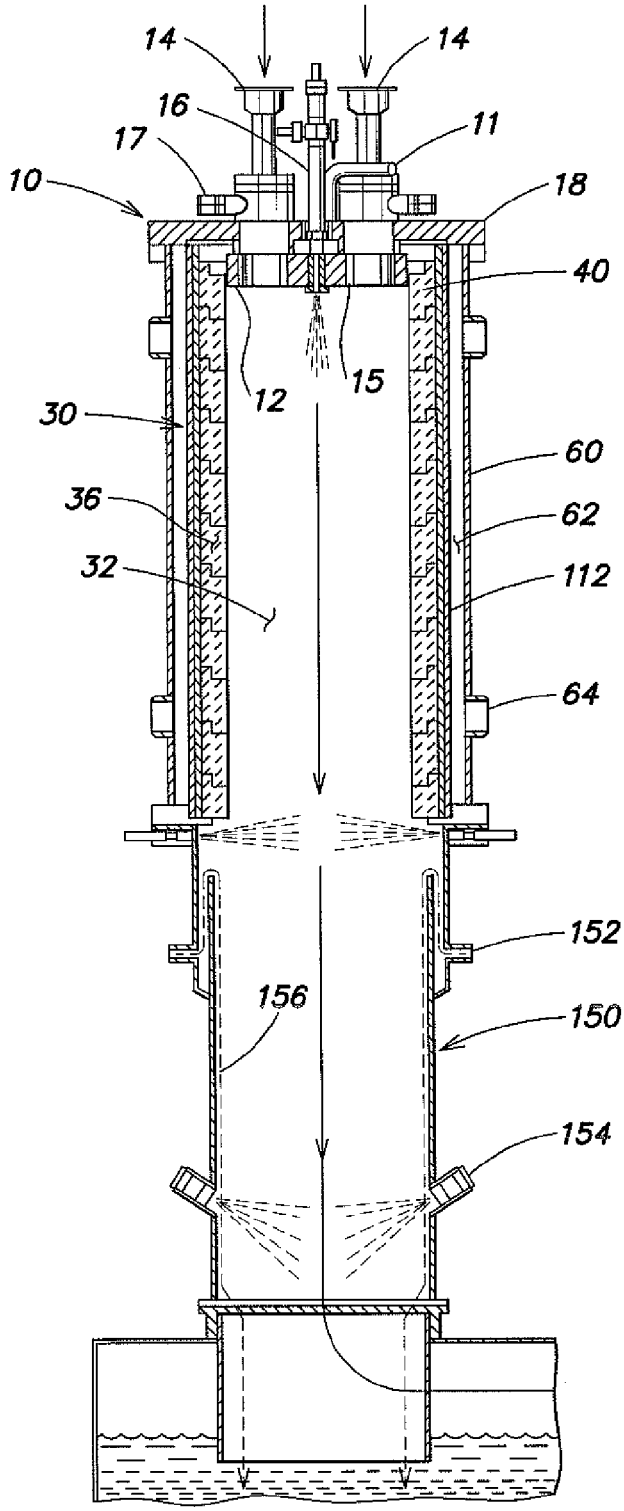
FIG. 1 is a cut away view of the thermal reaction unit, the inlet adaptor and the lower quenching chamber according to the invention

The improved thermal reaction system disclosed herein has a thermal reaction unit 30 and a lower quenching chamber 150 as shown in FIG. 1. The thermal reaction unit 30 includes a thermal reaction chamber 32, and an inlet adaptor 10 including a top plate 18, at least one waste gas inlet 14, at least one fuel inlet 17, optionally at least one oxidant inlet 11, burner jets 15, a center jet 16 and an interior plate 12 which is positioned at or within the thermal reaction chamber 32 (see also FIG. 3 for a schematic of the inlet adaptor independent of the thermal reaction unit). The inlet adaptor includes the fuel and oxidant gas inlets to provide a fuel rich gas mixture to the system for the destruction of contaminants. When oxidant is used, the fuel and oxidant may be pre-mixed prior to introduction into the thermal reaction chamber. Fuels contemplated herein include, but are not limited to, hydrogen, methane, natural gas, propane, LPG and city gas, preferably natural gas. Oxidants contemplated herein include, but are limited to, oxygen, ozone, air, clean dry air (CDA) and oxygen-enriched air. Waste gases to be abated comprise a species selected from the group consisting of $CF_4$, $C_2F_6$, $SF_6$, $C_3F_8$, $C_4H_8$, $C_4H_8O$, $SiF_4$, $BF_3$, $NF_3$, $BH_3$, $B_2H_6$, $B_5H_9$, $NH_3$, $PH_3$, $SiH_4$, $SeH_2$, $F_2$, $Cl_2$, HCl, HF, HBr, $WF_6$, $H_2$, $Al(CH_3)_3$, primary and secondary amines, organosilanes, organometallics, and halosilanes.

In one embodiment of the invention, the interior walls of the waste gas inlet 14 may be altered to reduce the affinity of particles for the interior walls of the inlet. For example, a surface may be electropolished to reduce the mechanical roughness (Ra) to a value less than 30, more preferably less than 17, most preferably less than 4. Reducing the mechanical roughness reduces the amount of particulate matter that adheres to the surface as well as improving the corrosion resistance of the surface. In the alternative, the interior wall of the inlet may be coated with a fluoropolymer coating, for example Teflon® or Halar®, which will also act to reduce the amount of particulate matter adhered at the interior wall as well as allow for easy cleaning. Pure Teflon® or pure Halar® layers are preferred, however, these materials are easily scratched or abraded. As such, in practice, the fluoropolymer coating is applied as follows. First the surface to be coated is cleaned with a solvent to remove oils, etc. Then, the surface is bead-blasted to provide texture thereto. Following texturization, a pure layer of fluoropolymer, e.g., Teflon®, a layer of ceramic filled fluoropolymer, and another pure layer of fluoropolymer are deposited on the surface in that order. The resultant fluoropolymer-containing layer is essentially scratch-resistant.

In another embodiment of the invention, the waste gas inlet 14 tube is subjected to thermophoresis, wherein the interior wall of the inlet is heated thereby reducing particle adhesion thereto. Thermophoresis may be effected by actually heating the surface of the interior wall with an on-line heater or alternatively, a hot nitrogen gas injection may be used, whereby 50-100 L per minute of hot nitrogen gas flows through the inlet. The additional advantage of the latter is the nitrogen gas flow minimizes the amount of time waste gases reside in the inlet thereby minimizing the possibility of nucleation therein.

Figure 2:
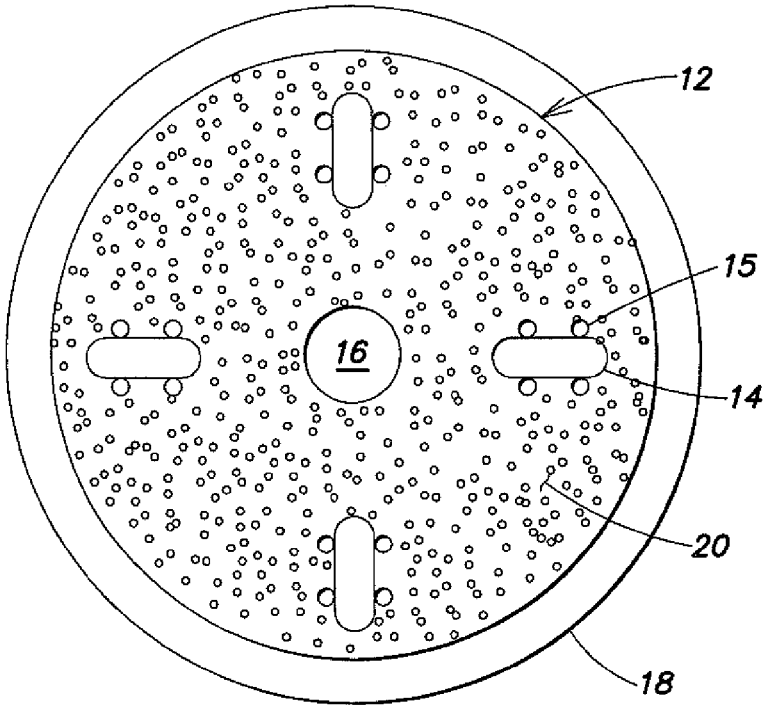
FIG. 2 is an elevational view of the interior plate of the inlet adaptor according to the invention.

Prior art inlet adaptors have included limited porosity ceramic plates as the interior plate of the inlet adaptor. A disadvantage of these limited porosity interior plates includes the accumulation of particles on said surface, eventually leading to inlet port clogging and flame detection error. The present invention overcomes these disadvantages by using a reticulated ceramic foam as the interior plate 12. FIG. 2 represents an elevational view of the interior plate 12, including the inlet ports 14, burner jets 15, a center jet port 16 (to be discussed hereinafter) and the reticulated ceramic foam 20 of the interior plate. Importantly, the reticulated ceramic foam 20 has a plurality of pores disposed therethrough. As such, the invention contemplates the passage of fluids through the pores of the interior plate to the thermal reaction chamber 32 to reduce the deposition of particulate matter at the surface of the interior plate 12 and the walls of the thermal reaction unit 30 proximate to the interior plate 12. The fluid may include any gas that is preferably pressurized to a suitable pressure, which upon diffusion through the material is sufficient to reduce deposition on the interior plate while not detrimentally affecting the abatement treatment in the thermal reaction chamber. Gases contemplated herein for passage through the pores of the interior plate 12 include air, CDA, oxygen-enriched air, oxygen, ozone and inert gases, e.g., Ar, $N_2$, etc., and should be devoid of fuels. Further, the fluid may be introduced in a continuous or a pulsating mode, preferably a continuous mode.

Although not wishing to be bound by theory, the reticulated ceramic foam interior plate helps prevent particle buildup on the interior plate in part because the exposed planar surface area is reduced thereby reducing the amount of surface available for build-up, because the reticulation of the interior plate provides smaller attachment points for growing particulate matter which will depart the interior plate upon attainment of a critical mass and because the air passing through the pores of the interior plate forms a "boundary layer," keeping particles from migrating to the surface for deposition thereon.

Ceramic foam bodies have an open cell structure characterized by a plurality of interconnected voids surrounded by a web of ceramic structure. They exhibit excellent physical properties such as high strength, low thermal mass, high thermal shock resistance, and high resistance to corrosion at elevated temperatures. Preferably, the voids are uniformly distributed throughout the material and the voids are of a size that permits fluids to easily diffuse through the material. The ceramic foam bodies should not react appreciably with PFC's in the effluent to form highly volatile halogen species. The ceramic foam bodies may include alumina materials, magnesium oxide, refractory metal oxides such as $ZrO_2$, silicon carbide and silicon nitride, preferably higher purity alumina materials, e.g., spinel, and yttria-doped alumina materials. Most preferably, the ceramic foam bodies are ceramic bodies formed from yttria-doped alumina materials and yttria-stabilized zirconia-alumina (YZA). The preparation of ceramic foam bodies is well within the knowledge of those skilled in the art.

Figure 3:
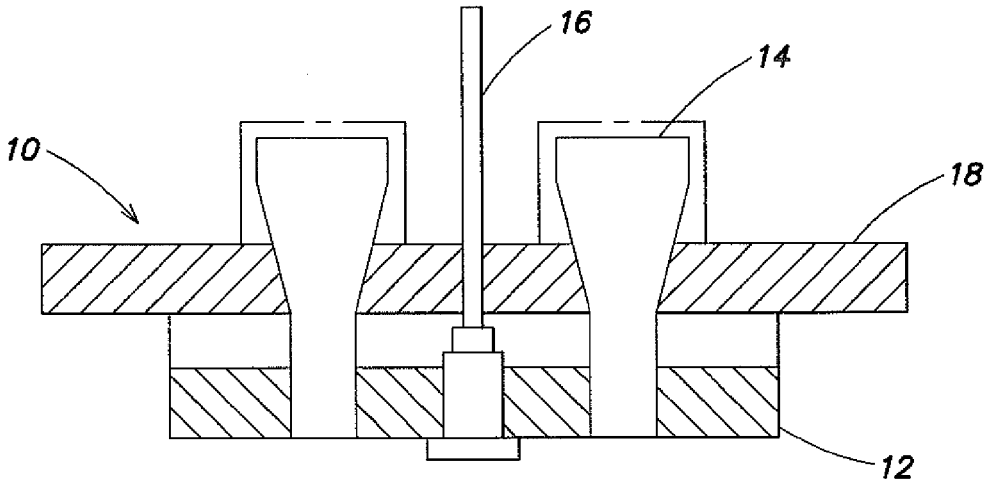
FIG. 3 is a partial cut-away view of the inlet adaptor according to the invention.
Figure 4:
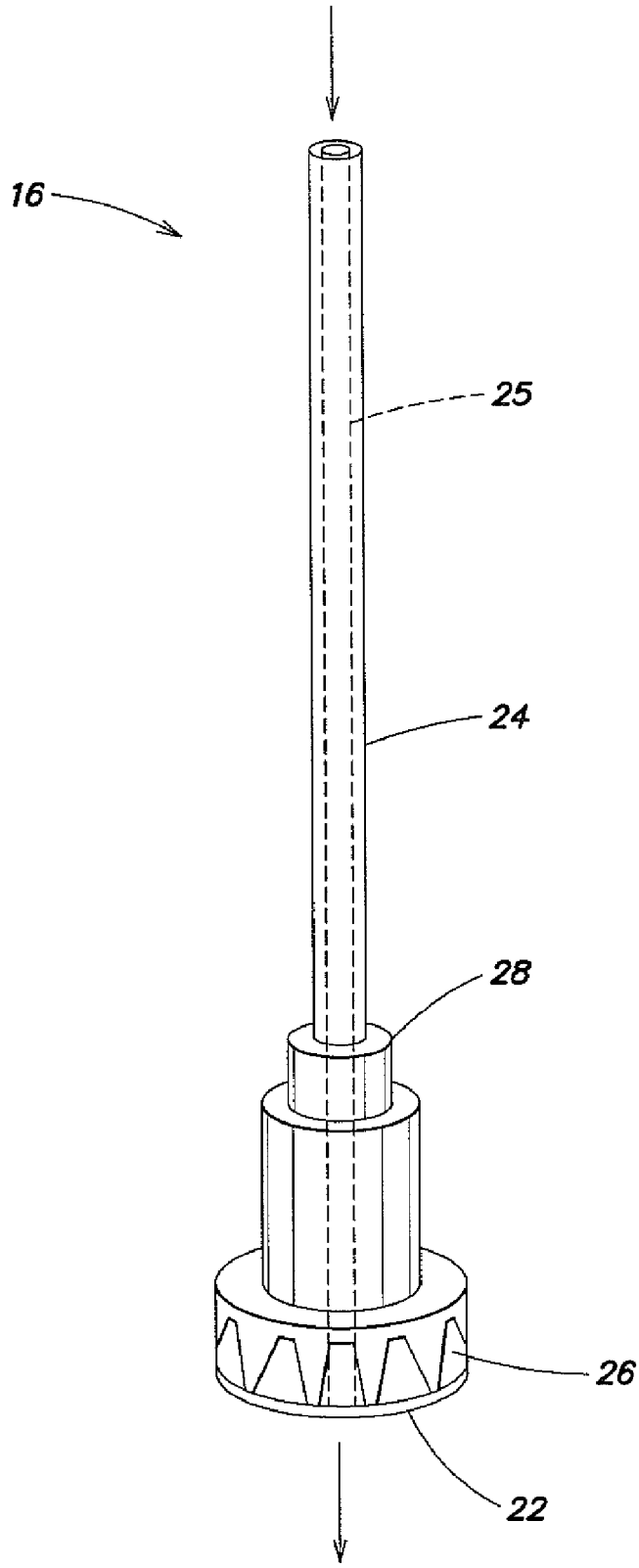
FIG. 4 is a view of a center jet according to the invention for introducing a high velocity air stream into the thermal reaction chamber.
Figure 5:
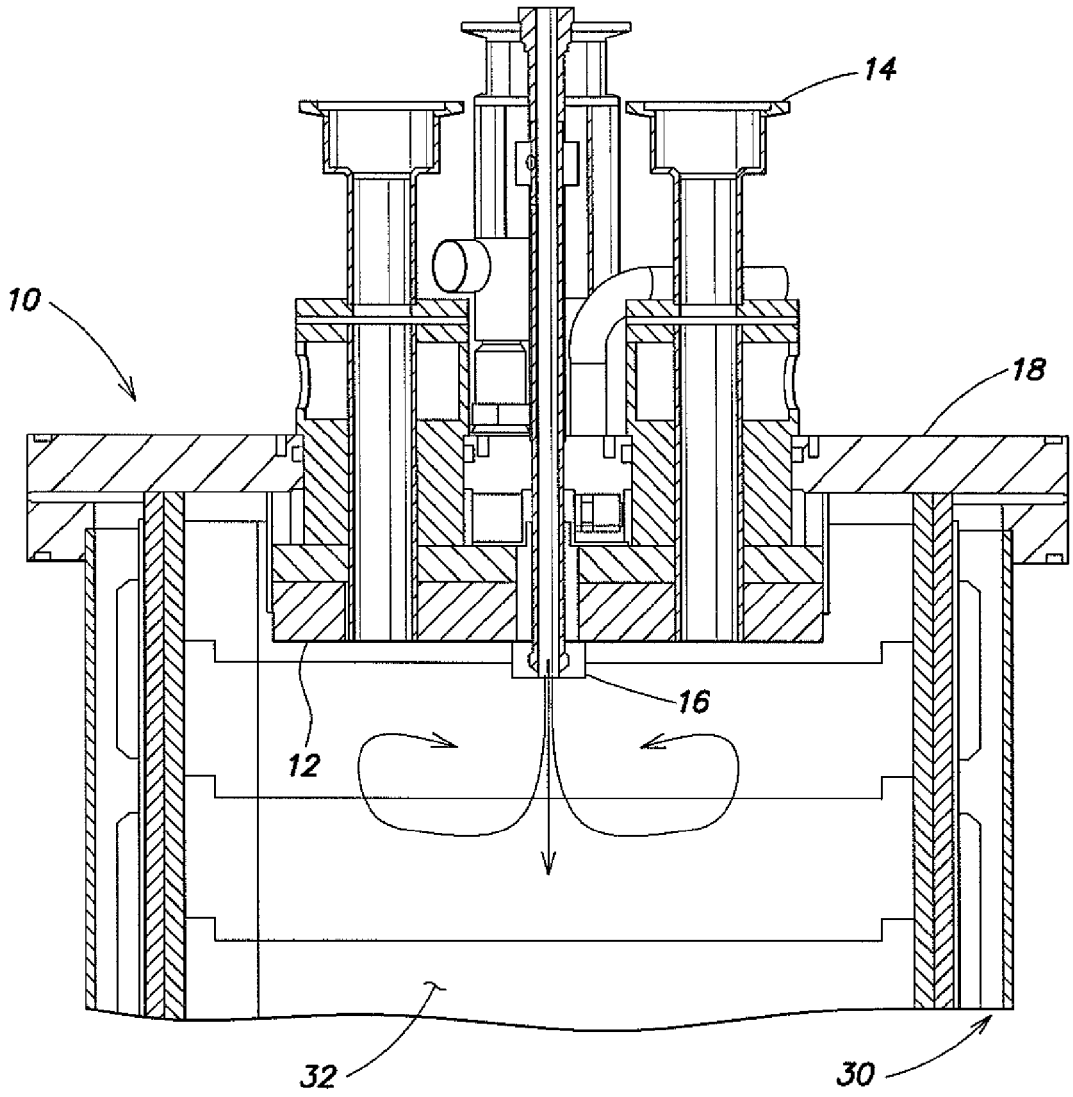
FIG. 5 is a cut away view of the inlet adaptor and the thermal reaction unit according to the invention.

To further reduce particle build-up on the interior plate 12, a fluid inlet passageway may be incorporated into the center jet 16 of the inlet adaptor 10 (see for example FIGS. 1, 3 and 5 for placement of the center jet in the inlet adaptor). An embodiment of the center jet 16 is illustrated in FIG. 4, said center jet including a pilot injection manifold tube 24, pilot ports 26, a pilot flame protective plate 22 and a fastening means 28, e.g., threading complementary to threading on the inlet adaptor, whereby the center jet and the inlet adaptor may be complementarily mated with one another in a leak-tight fashion. The pilot flame of the center jet 16 is used to ignite the burner jets 15 of the inlet adaptor. Through the center of the center jet 16 is a bore-hole 25 through which a stream of high velocity fluid may be introduced to inject into the thermal reaction chamber 32 (see, e.g., FIG. 5). Although not wishing to be bound by theory, it is thought that the high velocity air alters the aerodynamics and pulls gaseous and/or particulate components of the thermal reaction chamber towards the center of the chamber thereby keeping the particulate matter from getting close to the top plate and the chamber walls proximate to the top plate. The high velocity fluid may include any gas sufficient to reduce deposition on the interior walls of the thermal reaction unit while not detrimentally affecting the abatement treatment in the thermal reaction chamber. Further, the fluid may be introduced in a continuous or a pulsating mode, preferably a continuous mode. Gases contemplated herein include air, CDA, oxygen-enriched air, oxygen, ozone and inert gases, e.g., Ar, $N_2$, etc. Preferably, the gas is CDA and may be oxygen-enriched. In another embodiment, the high velocity fluid is heated prior to introduction into the thermal reaction chamber.

Figure 6A:
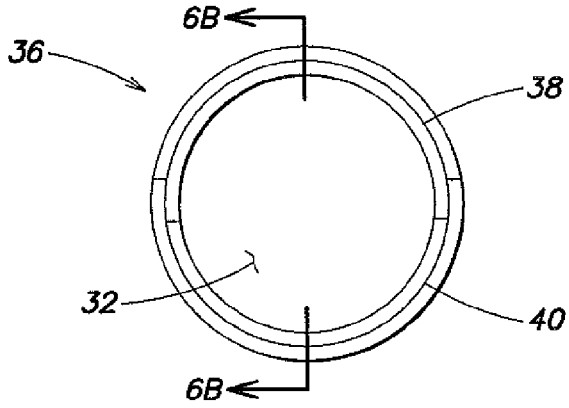
FIG. 6A is an elevational view of a ceramic ring of the thermal reaction unit according to the invention.
Figure 6B:
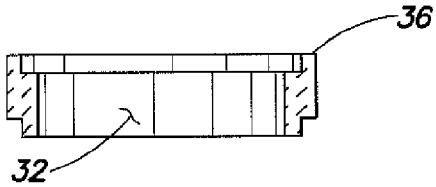
FIG. 6B is a partial cut-away view of the ceramic ring.
Figure 6C:
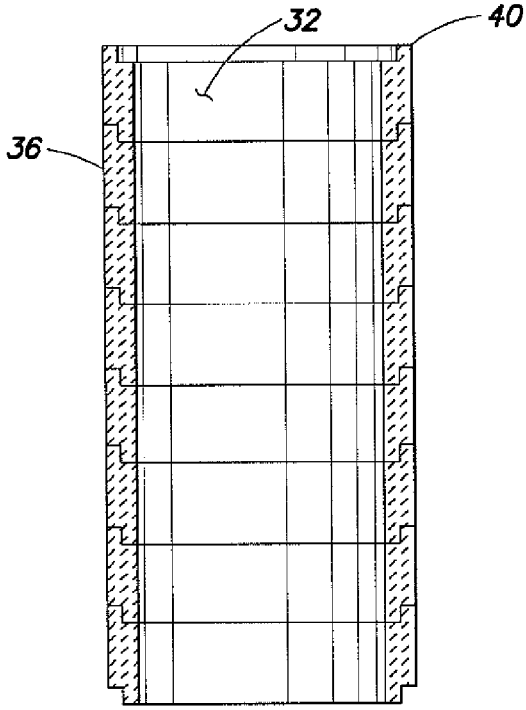
FIG. 6C is a partial cut-away view of ceramic rings stacked upon one another to define the thermal reaction chamber of the present invention.

In yet another embodiment, the thermal reaction unit includes a porous ceramic cylinder design defining the thermal reaction chamber 32. High velocity air may be directed through the pores of the thermal reaction unit 30 to at least partially reduce particle buildup on the interior walls of the thermal reaction unit. The ceramic cylinder of the present invention includes at least two ceramic rings stacked upon one another, for example as illustrated in FIG. 6C. More preferably, the ceramic cylinder includes at least about two to about twenty rings stacked upon one another. It is understood that the term "ring" is not limited to circular rings per se, but may also include rings of any polygonal or elliptical shape. Preferably, the rings are generally tubular in form.

FIG. 6C is a partial cut-away view of the ceramic cylinder design of the present invention showing the stacking of the individual ceramic rings 36 having a complimentary ship-lap joint design, wherein the stacked ceramic rings define the thermal reaction chamber 32. The uppermost ceramic ring 40 is designed to accommodate the inlet adaptor. It is noted that the joint design is not limited to lap joints but may also include beveled joints, butt joints, lap joints and tongue and groove joints. Gasketing or sealing means, e.g., GRAFOIL® or other high temperature materials, positioned between the stacked rings is contemplated herein, especially if the stacked ceramic rings are butt jointed. Preferably, the joints between the stacked ceramic rings overlap, e.g., ship-lap, to prevent infrared radiation from escaping from the thermal reaction chamber.

Each ceramic ring may be a circumferentially continuous ceramic ring or alternatively, may be at least two sections that may be joined together to make up the ceramic ring. FIG. 6A illustrates the latter embodiment, wherein the ceramic ring 36 includes a first arcuate section 38 and a second arcuate section 40, and when the first and second arcuate sections are coupled together, a ring is formed that defines a portion of the thermal reaction chamber 32. The ceramic rings are preferably formed of the same materials as the ceramic foam bodies discussed previously, e.g., YZA.

The advantage of having a thermal reaction chamber defined by individual stacked ceramic rings includes the reduction of cracking of the ceramic rings of the chamber due to thermal shock and concomitantly a reduction of equipment costs. For example, if one ceramic ring cracks, the damaged ring may be readily replaced for a fraction of the cost and the thermal reactor placed back online immediately.

Figure 7:
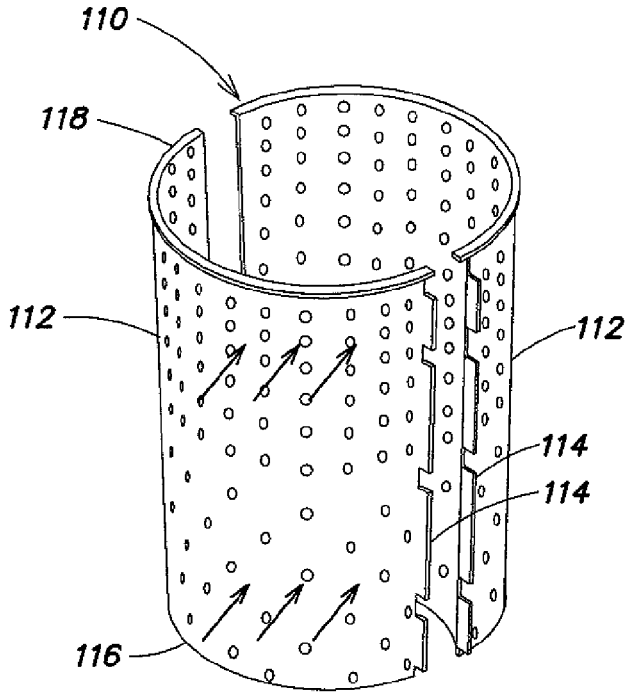
FIG. 7 is a view of the sections of the perforated metal shell according to the invention.

The ceramic rings of the invention must be held to another to form the thermal reaction unit 30 whereby high velocity air may be directed through the pores of the ceramic rings of the thermal reaction unit to at least partially reduce particle buildup at the interior walls of the thermal reaction unit. Towards that end, a perforated metal shell may be used to encase the stacked ceramic rings of the thermal reaction unit as well as control the flow of axially directed air through the porous interior walls of the thermal reaction unit. FIG. 7 illustrates an embodiment of the perforated metal shell 110 of the present invention, wherein the metal shell has the same general form of the stacked ceramic rings, e.g., a circular cylinder or a polygonal cylinder, and the metal shell includes at least two attachable sections 112 that may be joined together to make up the general form of the ceramic cylinder. The two attachable sections 112 include ribs 114, e.g., clampable extensions 114, which upon coupling put pressure on the ceramic rings thereby holding the rings to one another.

Figure 8:
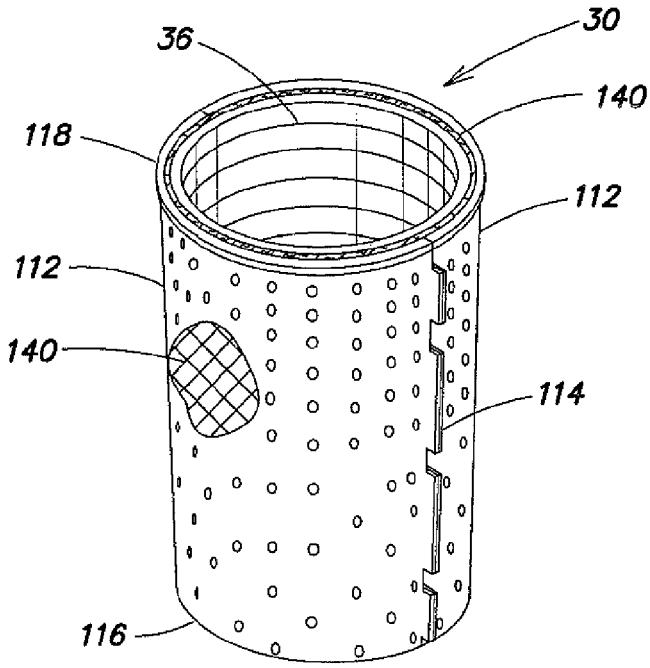
FIG. 8 is an exterior view of the thermal reaction unit according to the invention.

The metal shell 110 has a perforated pattern whereby preferably more air is directed towards the top of the thermal reaction unit, e.g., the portion closer to the inlet adaptor 10, than the bottom of the thermal reaction unit, e.g., the lower chamber (see FIGS. 7 and 8). In the alternative, the perforated pattern is the same throughout the metal shell. As defined herein, "perforations" may represent any array of openings through the metal shell that do not compromise the integrity and strength of the metal shell, while ensuring that the flow of axially directed air through the porous interior walls may be controlled. For example, the perforations may be holes having circular, polygonal or elliptical shapes or in the alternative, the perforations may be slits of various lengths and widths. In one embodiment, the perforations are holes 1/16" in diameter, and the perforation pattern towards the top of the thermal reaction unit has 1 hole per square inch, while the perforation pattern towards the bottom of the thermal reaction unit has 0.5 holes per square inch (in other words 2 holes per 4 square inches). Preferably, the perforation area is about 0.1% to 1% of the area of the metal shell. The metal shell is constructed from corrosion-resistant metals including, but not limited to: stainless steel; austenitic nickel-chromium-iron alloys such as Inconel® 600, 601, 617, 625, 625 LCF, 706, 718, 718 SPF, X-750, MA754, 783, 792, and HX; and other nickel-based alloys such as Hastelloy B, B2, C, C22, C276, C2000, G, G2, G3 and G30.

Referring to FIG. 8, the thermal reaction unit of the invention is illustrated. The ceramic rings 36 are stacked upon one another, at least one layer of a fibrous blanket 140 is wrapped around the exterior of the stacked ceramic rings and then the sections 112 of the metal shell 110 are positioned around the fibrous blanket 140 and tightly attached together by coupling the ribs 114. The fibrous blanket 140 can be any fibrous inorganic material having a low thermal conductivity, high temperature capability and an ability to deal with the thermal expansion coefficient mismatch of the metal shell and the ceramic rings. Fibrous blanket material contemplated herein includes, but is not limited to, spinel fibers, glass wool and other materials comprising aluminum silicates. In the alternative, the fibrous blanket 140 may be a soft ceramic sleeve.

In practice, fluid flow is axially and controllably introduced through the perforations of the metal shell, the fibrous blanket 140 and the reticulated ceramic rings of the cylinder. The fluid experiences a pressure drop from the exterior of the thermal reaction unit to the interior of the thermal reaction unit in a range from about 0.05 psi to about 0.30 psi, preferably about 0.1 psi to 0.2 psi. The fluid may be introduced in a continuous or a pulsating mode, preferably a continuous mode to reduce the recirculation of the fluid within the thermal reaction chamber. It should be appreciated that an increased residence time within the thermal reaction chamber, wherein the gases are recirculated, results in the formation of larger particulate material and an increased probability of deposition within the reactor. The fluid may include any gas sufficient to reduce deposition on the interior walls of the ceramic rings while not detrimentally affecting the abatement treatment in the thermal reaction chamber. Gases contemplated include air, CDA, oxygen-enriched air, oxygen, ozone and inert gases, e.g., Ar, $N_2$, etc.

To introduce fluid to the walls of the thermal reaction unit for passage through to the thermal reaction chamber 32, the entire thermal reaction unit 30 is encased within an outer stainless steel reactor shell 60 (see, e.g., FIG. 1), whereby an annular space 62 is created between the interior wall of the outer reactor shell 60 and the exterior wall of the thermal reaction unit 30. Fluids to be introduced through the walls of the thermal reaction unit may be introduced at ports 64 positioned on the outer reactor shell 60.

Figure 9:
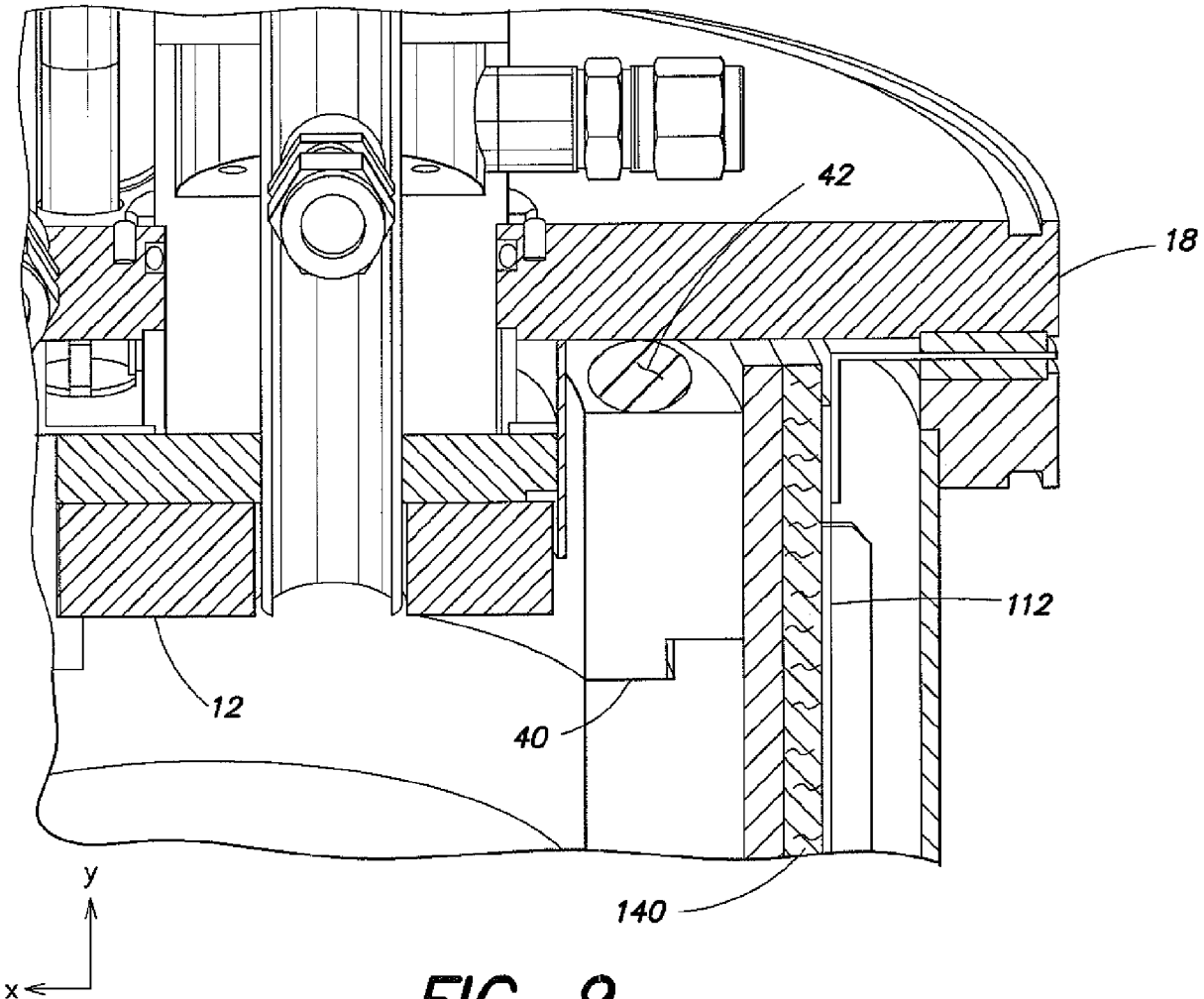
FIG. 9 is a partial cut-away view of the inlet adaptor/thermal reaction unit joint according to the invention.

Referring to FIG. 1, the interior plate 12 of the inlet adaptor 10 is positioned at or within the thermal reaction chamber 32 of the thermal reaction unit 30. To ensure that gases within the thermal reaction unit do not leak from the region where the inlet adaptor contacts the thermal reaction unit, a gasket or seal 42 is preferably positioned between the top ceramic ring 40 and the top plate 18 (see, e.g., FIG. 9). The gasket or seal 42 may be GRAFOIL® or some other high temperature material that will prevent leakage of blow-off air through the top plate/thermal reaction unit joint, i.e., to maintain a backpressure behind the ceramic rings for gas distribution.

Figure 10A:
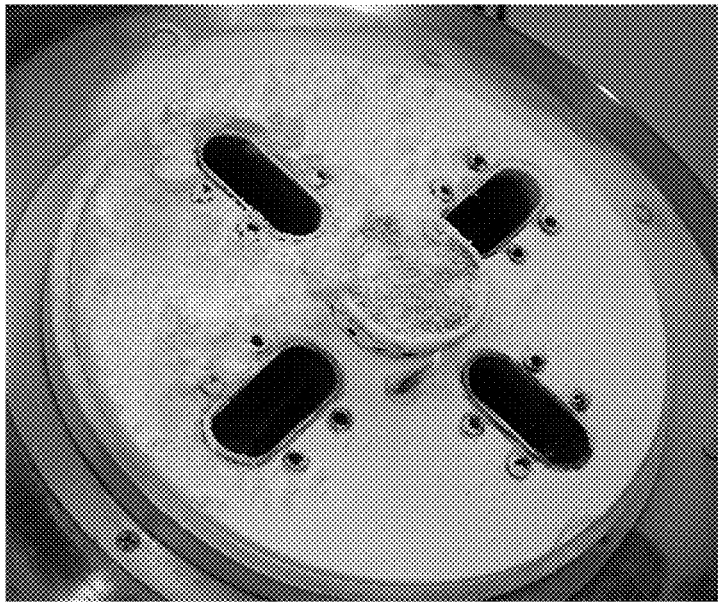
FIG. 10A (Prior Art)
FIG. 10A is a photograph of the deposition of residue on the interior plate of the inlet adaptor of the prior art.
Figure 10B:
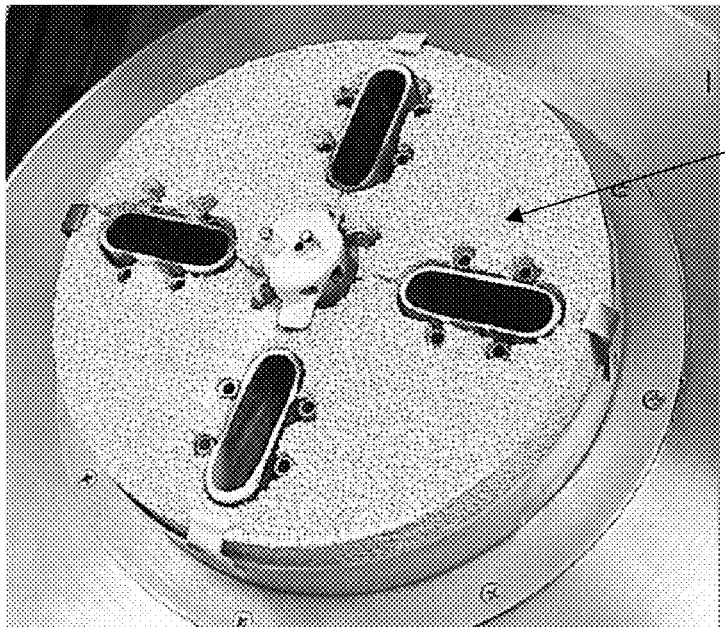
FIG. 10B is a photograph of the deposition of residue on the interior plate of the inlet adaptor according to the invention.

FIGS. 10A and 10B show the buildup of particulate matter on a prior art interior plate and an interior plate according to the present invention, respectively. It can be seen that the buildup on the interior plate of the present invention (having a reticulated foam plate with fluid emanating from the pores, a reticulated ceramic cylinder with fluid emanating from the pores and high velocity fluid egression from the center jet) is substantially reduced relative to the interior plate of the prior art, which is devoid of the novel improvements disclosed herein.

Figure 11A:
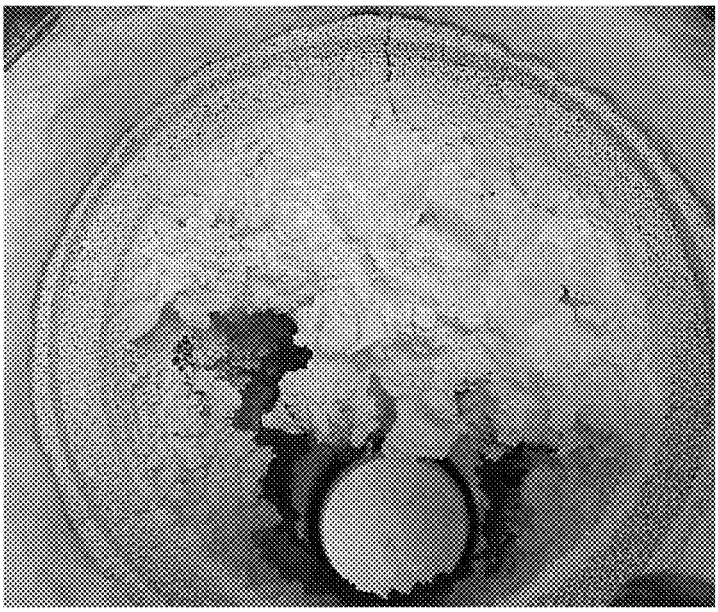
FIG. 11A (Prior Art)
FIG. 11A is a photograph of the deposition of residue on the interior walls of the thermal reaction unit of the prior art.
Figure 11B:
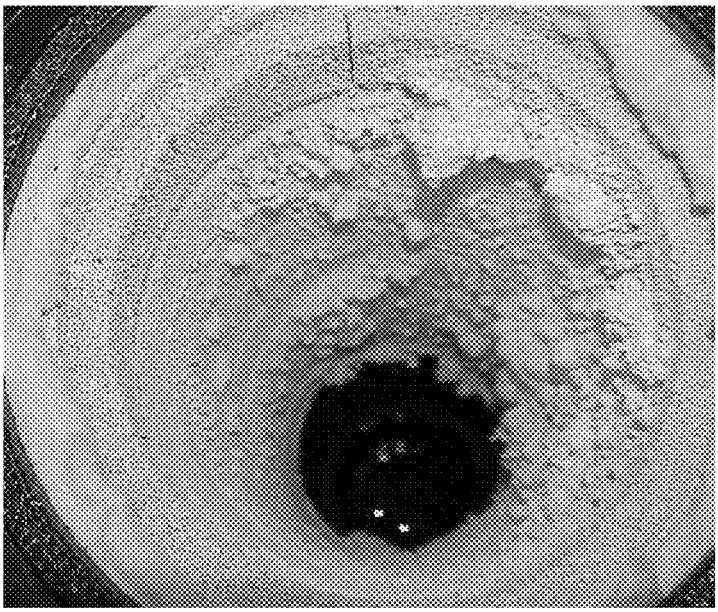
FIG. 11B is a photograph of the deposition of residue on the interior walls of the thermal reaction unit according to the invention.

FIGS. 11A and 11B represent photographs of prior art thermal reaction units and the thermal reaction unit according to the present invention, respectively. It can be seen that the buildup of particulate matter on the interior walls of the thermal reaction unit of the present invention is substantially reduced relative to prior art thermal reaction unit walls. Using the apparatus and method described herein, the amount of particulate buildup at the interior walls of the thermal reaction unit is reduced by at least 50%, preferably at least 70% and more preferably at least 80%, relative to prior art units oxidizing an equivalent amount of effluent gas.

Downstream of the thermal reaction chamber is a water quenching means positioned in the lower quenching chamber 150 to capture the particulate matter that egresses from the thermal reaction chamber. The water quenching means may include a water curtain as disclosed in co-pending U.S. patent application Ser. No. 10/249,703 in the name of Glenn Tom et al., entitled "Gas Processing System Comprising a Water Curtain for Preventing Solids Deposition on Interior Walls Thereof," which is hereby incorporated by reference in the entirety. Referring to FIG. 1, the water for the water curtain is introduced at inlet 152 and water curtain 156 is formed, whereby the water curtain absorbs the heat of the combustion and decomposition reactions occurring in the thermal reaction unit 30, eliminates build-up of particulate matter on the walls of the lower quenching chamber 150, and absorbs water soluble gaseous products of the decomposition and combustion reactions, e.g., $CO_2$, HF, etc.

To ensure that the bottom-most ceramic ring does not get wet, a shield 202 (see, e.g., FIG. 12) may be positioned between the bottom-most ceramic ring 198 and the water curtain in the lower chamber 150. Preferably, the shield is L-shaped and assumes the three-dimensional form of the bottom-most ceramic ring, e.g., a circular ring, so that water does not come in contact with the bottom-most ceramic ring. The shield may be constructed from any material that is water- and corrosion-resistant and thermally stable including, but not limited to: stainless steel; austenitic nickel-chromium-iron alloys such as Inconel® 600, 601, 617, 625, 625 LCF, 706, 718, 718 SPF, X-750, MA754, 783, 792, and HX; and other nickel-based alloys such as Hastelloy B, B2, C, C22, C276, C2000, G, G2, G3 and G30.

In practice, effluent gases enter the thermal reaction chamber 32 from at least one inlet provided in the inlet adaptor 10, and the fuel/oxidant mixture enter the thermal reaction chamber 32 from at least one burner jet 15. The pilot flame of the center jet 16 is used to ignite the burner jets 15 of the inlet adaptor, creating thermal reaction unit temperatures in a range from about 500° C. to about 2000° C. The high temperatures facilitate decomposition of the effluent gases that are present within the thermal reaction chamber. It is also possible that some effluent gases undergo combustion/oxidation in the presence of the fuel/oxidant mixture. The pressure within the thermal reaction chamber is in a range from about 0.5 atm to about 5 atm, preferably slightly subatmospheric, e.g., about 0.98 atm to about 0.99 atm.

Following decomposition/combustion, the effluent gases pass to the lower chamber 150 wherein a water curtain 156 may be used to cool the walls of the lower chamber and inhibit deposition of particulate matter on the walls. It is contemplated that some particulate matter and water soluble gases may be removed from the gas stream using the water curtain 156. Further downstream of the water curtain, a water spraying means 154 may be positioned within the lower quenching chamber 150 to cool the gas stream, and remove the particulate matter and water soluble gases. Cooling the gas stream allows for the use of lower temperature materials downstream of the water spraying means thereby reducing material costs. Gases passing through the lower quenching chamber may be released to the atmosphere or alternatively may be directed to additional treatment units including, but not limited to, liquid/liquid scrubbing, physical and/or chemical adsorption, coal traps, electrostatic precipitators, and cyclones. Following passage through the thermal reaction unit and the lower quenching chamber, the concentration of the effluent gases is preferably below detection limits, e.g., less than 1 ppm. Specifically, the apparatus and method described herein removes greater than 90% of the toxic effluent components that enter the abatement apparatus, preferably greater than 98%, most preferably greater than 99.9%.

Figure 12:
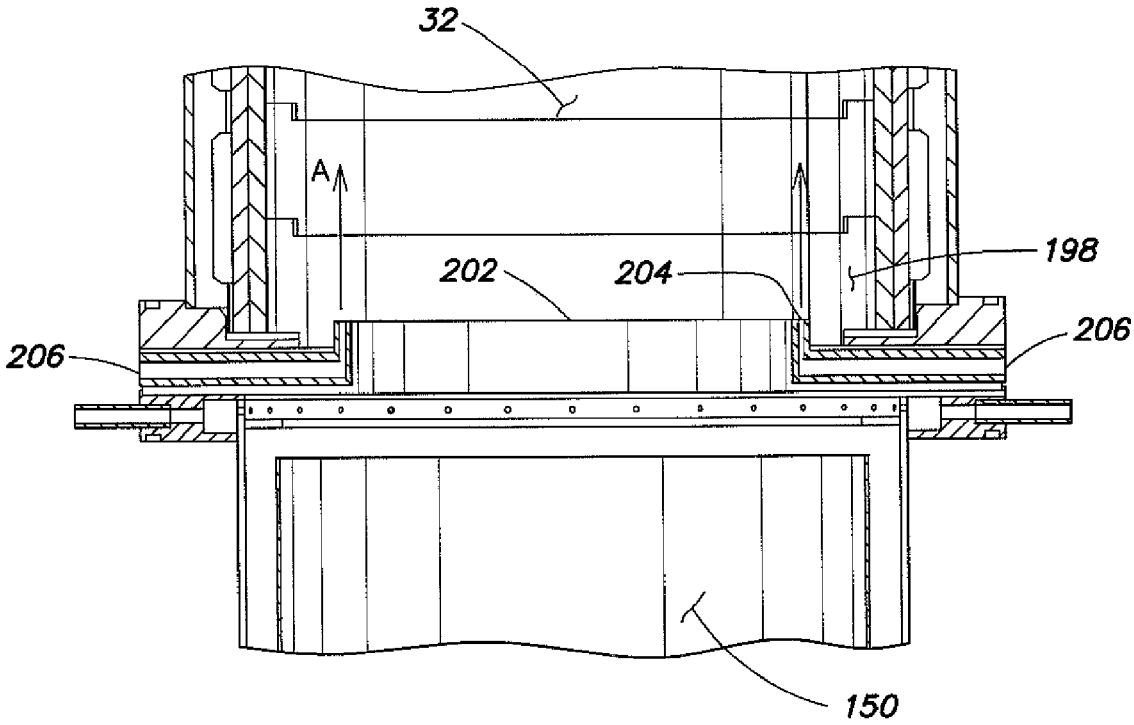
FIG. 12 is a partial cut-away view of the shield positioned between the thermal reaction unit and the lower quenching chamber according to the invention.

In an alternative embodiment, an "air knife" is positioned within the thermal reaction unit. Referring to FIG. 12, fluid may be intermittently injected into the air knife inlet 206, which is situated between the bottom-most ceramic ring 198 and the water quenching means in the lower quenching chamber 150. The air knife inlet 206 may be incorporated into the shield 202 which prevents water from wetting the bottom-most ceramic ring 198 as described hereinabove. The air knife fluid may include any gas sufficient to reduce deposition on the interior walls of the thermal reaction unit while not detrimentally affecting the decomposition treatment in said unit. Gases contemplated include air, CDA, oxygen-enriched air, oxygen, ozone and inert gases, e.g., Ar, $N_2$, etc. In operation, gas is intermittently injected through the air knife inlet 206 and exits a very thin slit 204 that is positioned parallel to the interior wall of the thermal reaction chamber 32. Thus, gases are directed upwards along the wall (in the direction of the arrows in FIG. 12) to force any deposited particulate matter from the surface of the interior wall.

EXAMPLE

To demonstrate the abatement effectiveness of the improved thermal reactor described herein, a series of experiments were performed to quantify the efficiency of abatement using said thermal reactor. It can be seen that greater than 99% of the test gases were abated using the improved thermal reactor, as shown in Table 1.

TABLE 1

Results of abatement experiments using the embodiments described herein.

| Test gas | Flow rate/slm | Fuel/slm | DRE, % |
|---|---|---|---|
| $C_2F_6$ | 2.00 | 50 | >99.9% |
| $C_3F_8$ | 2.00 | 45 | >99.9% |
| $NF_3$ | 2.00 | 33 | >99.9% |
| $SF_6$ | 5.00 | 40 | 99.6% |
| $CF_4$ | 0.25 | 86 | 99.5% |
| $CF_4$ | 0.25 | 83 | 99.5% |

Although the invention has been variously described herein with reference to illustrative embodiments and features, it will be appreciated that the embodiments and features described hereinabove are not intended to limit the invention, and that other variations, modifications and other embodiments will readily suggest themselves to those of ordinary skill in the art, based on the disclosure herein. The invention therefore is to be broadly construed, consistent with the claims hereafter set forth.

The invention claimed is:

1. A thermal abatement reactor for removing pollutant from waste gas, the thermal reactor comprising:

a thermal reaction unit comprising:

an exterior wall having a plurality of perforations for passage of a fluid therethrough;

a porous ceramic interior wall defining a thermal reaction chamber, wherein the interior wall comprises at least two ring sections in a stacked arrangement;

at least one waste gas inlet in fluid communication with the thermal reaction chamber for introducing a waste gas therein; and at least one fuel inlet in fluid communication with the thermal reaction chamber for introducing a fuel for use during decomposition of said waste gas in the thermal reaction chamber; and means for directing a fluid through the one or more perforations of the exterior wall and the porous ceramic interior wall to reduce the deposition and accumulation of particulate matter thereon; and a water quench unit coupled to the thermal reaction unit and adapted to receive a gas stream from the thermal reaction unit;

wherein the total number of perforations in proximity to the waste gas inlet and the fuel inlet is greater than the total number of perforations in proximity to the water quench unit.

2. The thermal abatement reactor of claim 1, coupled in waste gas receiving relationship to a process facility selected from the group consisting of a semiconductor manufacturing process facility and a liquid crystal display (LCD) process facility.

3. The thermal abatement reactor of claim 1, wherein the metal exterior wall has perforations that provide a pressure drop across the thermal reaction unit of greater than about 0.1 psi.

4. The thermal abatement reactor of claim 1, wherein the thermal reaction unit is adapted so that more fluid flows through the porous ceramic interior wall in proximity to the waste gas inlet and the fuel inlet than in proximity to the water quench unit.

5. The thermal abatement reactor of claim 1, wherein the at least two ring sections are complimentarily jointed for connection of adjacent stacked rings.

6. The thermal abatement reactor of claim 1, wherein the thermal reaction unit further comprises a porous ceramic plate positioned at or within the interior wall of the thermal reaction chamber, and wherein the porous ceramic plate encloses one end of said thermal reaction chamber.

7. The thermal abatement reactor of claim 6, further comprising means for directing fluid through the porous ceramic plate to reduce deposition and accumulation of particulate matter thereon.

8. The thermal abatement reactor of claim 6, further comprising a center jet in fluid communication with the thermal reaction chamber, wherein the center jet is in proximity to the at least one waste gas inlet and the at least one fuel inlet, and wherein the center jet is adapted to introduce high velocity fluid into the thermal reaction chamber through the center jet during decomposition of the waste gas to inhibit deposition and accumulation of particulate matter on the interior wall and porous ceramic plate of the thermal reaction chamber proximate to the center jet.

9. The thermal abatement reactor of claim 1, further comprising a water resistant shield between the thermal reaction unit and the water quench unit.

10. The thermal abatement reactor of claim 1, further comprising an outer reactor shell having an outer reactor shell interior wall, wherein an annular space is formed between the outer reactor shell interior wall and the exterior wall of the thermal reaction unit.

11. The thermal abatement reactor of claim 1, wherein the at least one waste gas inlet has an interior wall, and wherein the interior wall is coated with at least one layer of a coating material comprising a fluoropolymer.

12. The thermal abatement reactor of claim 1, wherein the porous ceramic interior wall comprises a reticulated ceramic interior wall.

13. A thermal abatement reactor for removing pollutant from waste gas, the thermal reactor comprising:

a thermal reaction unit comprising:

an exterior wall having a plurality of perforations for passage of a fluid therethrough;

a porous ceramic interior wall defining a thermal reaction chamber, wherein the interior wall comprises at least two ring sections in a stacked arrangement;

at least one waste gas inlet in fluid communication with the thermal reaction chamber for introducing a waste gas therein; and at least one fuel inlet in fluid communication with the thermal reaction chamber for introducing a fuel for use during decomposition of said waste gas in the thermal reaction chamber; and means for directing a fluid through the one or more perforations of the exterior wall and the porous ceramic interior wall to reduce the deposition and accumulation of particulate matter thereon;

a water quench unit coupled to the thermal reaction unit and adapted to receive a gas stream from the thermal reaction unit; and a fibrous material disposed between the exterior wall and the porous ceramic interior wall.

14. The thermal abatement reactor of 13, wherein the fibrous material comprises material selected from the group consisting of spinel fibers, glass wool and aluminum silicate.

15. The thermal abatement reactor of claim 13, coupled in waste gas receiving relationship to a process facility selected from the group consisting of a semiconductor manufacturing process facility and a liquid crystal display (LCD) process facility.

16. The thermal abatement reactor of claim 13, wherein the metal exterior wall has perforations that provide a pressure drop across the thermal reaction unit of greater than about 0.1 psi.

17. The thermal reactor of claim 13, wherein the thermal reaction unit is adapted so that more fluid flows through the porous ceramic interior wall in proximity to the waste gas inlet and the fuel inlet than in proximity to the water quench unit.

18. The thermal abatement reactor of claim 13, wherein the at least two ring sections are complimentarily jointed for connection of adjacent stacked rings.

19. The thermal abatement reactor of claim 13, wherein the thermal reaction unit further comprises a porous ceramic plate positioned at or within the interior wall of the thermal reaction chamber, and wherein the porous ceramic plate encloses one end of said thermal reaction chamber.

20. The thermal abatement reactor of claim 19, further comprising means for directing fluid through the porous ceramic plate to reduce deposition and accumulation of particulate matter thereon.

21. The thermal reactor of claim 19, further comprising a center jet in fluid communication with the thermal reaction chamber, wherein the center jet is in proximity to the at least one waste gas inlet and the at least one fuel inlet, and wherein the center jet is adapted to introduce high velocity fluid into the thermal reaction chamber through the center jet during decomposition of the waste gas to inhibit deposition and accumulation of particulate matter on the interior wall and porous ceramic plate of the thermal reaction chamber proximate to the center jet.

22. The thermal abatement reactor of claim 13, further comprising a water resistant shield between the thermal reaction unit and the water quench unit.

23. The thermal abatement reactor of claim 13, further comprising an outer reactor shell having an outer reactor shell interior wall, wherein an annular space is formed between the outer reactor shell interior wall and the exterior wall of the thermal reaction unit.

24. The thermal abatement reactor of claim 13, wherein the at least one waste gas inlet has an interior wall, and wherein the interior wall is coated with at least one layer of a coating material comprising a fluoropolymer.

25. The thermal abatement reactor of claim 13, wherein the porous ceramic interior wall comprises a reticulated ceramic interior wall.

* * * * *

UNITED STATES PATENT AND TRADEMARK OFFICE

CERTIFICATE OF CORRECTION

PATENT NO. : 7,736,599 B2
APPLICATION NO. : 10/987921
DATED : June 15, 2010
INVENTOR(S) : Ho-Man Rodney Chiu It is certified that error appears in the above-identified patent and that said Letters Patent is hereby corrected as shown below:

Column 11, line 25, "thermal reactor" should be changed to "thermal abatement reactor"
Column 12, line 36, "thermal reactor" should be changed to "thermal abatement reactor"
Column 13, line 5, "thermal reactor" should be changed to "thermal abatement reactor"
Column 13, line 22, "thermal reactor" should be changed to "thermal abatement reactor"

Signed and Sealed this

Twenty-first Day of September, 2010

David J. Kappos

David J. Kappos
*Director of the United States Patent and Trademark Office*